US007219404B2

(12) United States Patent
Haga et al.

(10) Patent No.: US 7,219,404 B2
(45) Date of Patent: May 22, 2007

(54) RETAINING CLIP

(75) Inventors: Goro Haga, Tokyo (JP); David Kitt, Billericay (GB)

(73) Assignee: Japan Aviation Electronics Industry, Limited, Tokyo (JP)

( * ) Notice: Subject to any disclaimer, the term of this patent is extended or adjusted under 35 U.S.C. 154(b) by 249 days.

(21) Appl. No.: 10/918,124

(22) Filed: Aug. 13, 2004

(65) Prior Publication Data

US 2005/0044675 A1 Mar. 3, 2005

(30) Foreign Application Priority Data

Aug. 13, 2003 (GB) ..... 0319033.7

(51) Int. Cl.
*H01R 13/64* (2006.01)
*H01R 13/74* (2006.01)

(52) U.S. Cl. ..... 24/458; 24/563; 439/92; 439/607; 439/939

(58) Field of Classification Search ..... 439/939, 439/92, 607; 24/459, 543, 563, 458
See application file for complete search history.

(56) References Cited

U.S. PATENT DOCUMENTS 6,280,257 B1 * 8/2001 North et al. ..... 439/680
6,513,206 B1 2/2003 Banitt et al.
6,519,817 B1 * 2/2003 Lenhart et al. ..... 24/458

* cited by examiner

*Primary Examiner*—James R. Brittain
(74) *Attorney, Agent, or Firm*—Frishauf, Holtz, Goodman & Chick, P.C.

(57) ABSTRACT

A retaining clip is for securing an electrical connector to be inserted through an opening formed in a panel. The retaining clip comprises a base having an aperture therethrough for receiving the free end of the electrical connector and having one or more engagement means for engaging with and holding the electrical connector. The base is shaped to contact at least a portion of the surface of the panel that it overlies. A plurality of fingers extending away from the base are displaceable to allow insertion of a mating connector and to contact the surface of the mating connector. Thus, the clip shields the surface of the mating connector with respect to the panel.

7 Claims, 7 Drawing Sheets

RETAINING CLIP

This application claims priority to prior UK patent application No. 0319033.7, the disclosure of which is incorporated herein by reference.

BACKGROUND OF THE INVENTION

The present invention relates to retaining clips and in particular to retaining clips used to secure devices such as electrical connectors mounted through an aperture in the casing of a computer including servers or other electronic device.

In order to hold electrical connectors, such as data connectors, in position in an aperture in the casing of a computer it is well known to use pairs of c-shaped clips that abut the surface of the casing and engage either end of that portion of the electrical connector that projects beyond the aperture. U.S. Pat. No. 6,513,206 describes an alternative retaining clip which is illustrated in combination with a conventional electrical connector in FIG. 1. The retaining clip comprises a single planar element 1 having an aperture 2 for receiving the free end of an electrical connector 3 and locking tabs 4, 5. The locking tabs 4, 5 are arranged to engage with detent surfaces provided on the electrical connector by means of a sliding movement in the direction of arrow A.

SUMMARY OF THE INVENTION

The present invention seeks to provide an improvement on known retaining clips and in particular to provide retaining clips that contribute to the shielding of the electronic device of which the connector forms a part.

In accordance with the present invention there is provided a retaining clip for securing an electrical connector to be inserted through an opening formed in a panel, the retaining clip comprising a base having an aperture therethrough for receiving the free end of the electrical connector and having one or more engagement means for engaging with and holding the electrical connector, the base being shaped to contact at least a portion of the surface of the panel that it overlies; and a plurality of fingers extending away from the base being displaceable to allow insertion of a mating connector and to contact the surface of the mating connector whereby the clip shields the surface of the mating connector with respect to the panel.

Thus with the present invention the retaining clip provides the additional function of em shielding.

DESCRIPTION OF THE PREFERRED EMBODIMENTS

Figure 1:
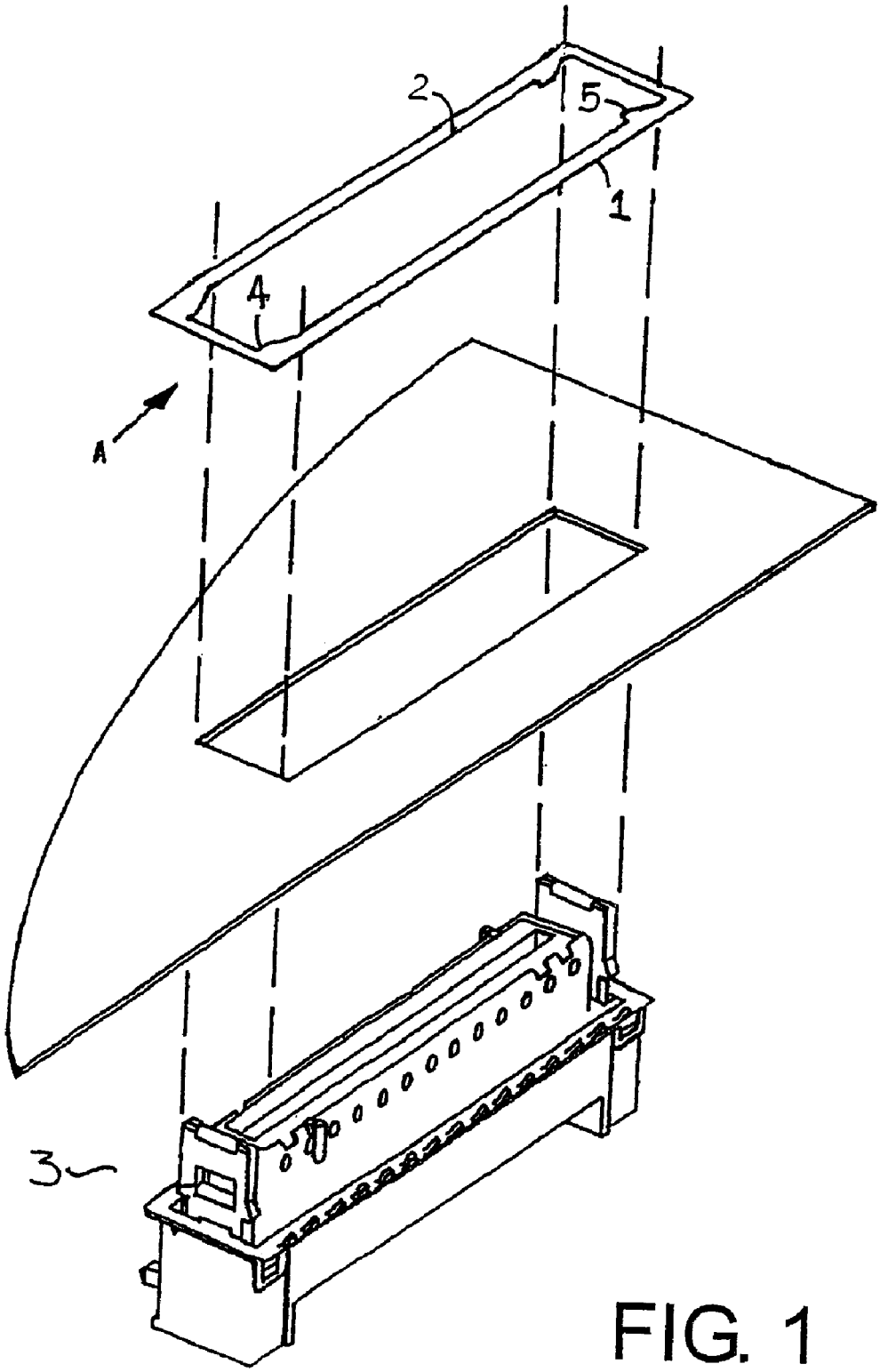
FIG. 1 (PRIOR ART)
FIG. 1 is an exploded perspective view of a known retaining clip.
Figure 2:
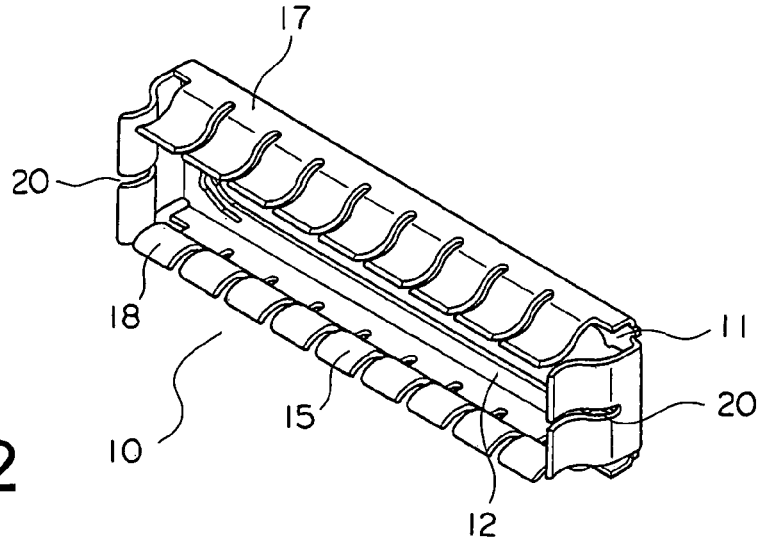
FIG. 2 is a perspective view from the front of a retaining clip in accordance with the present invention.
Figure 3:
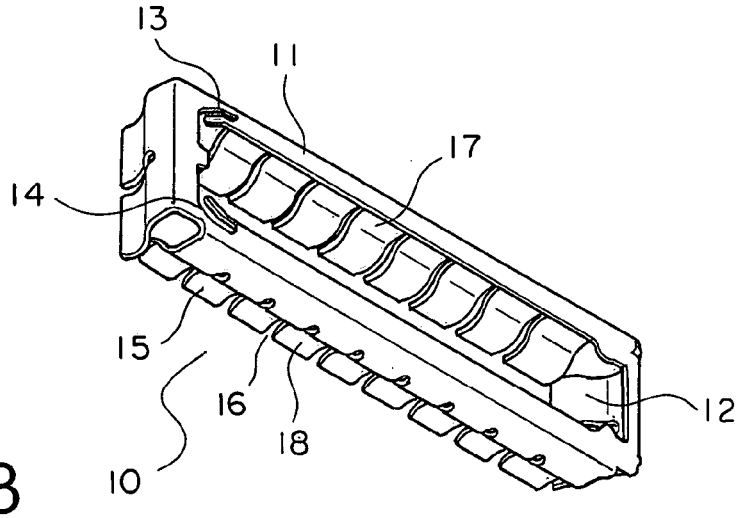
FIG. 3 is a perspective from the rear of the retaining clip of FIG. 2.
Figure 4:
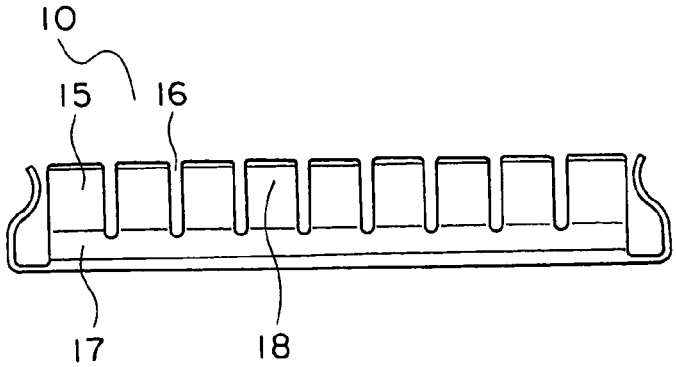
FIG. 4 is a plan view from one side of the retaining clip of FIGS. 2 and 3.

As shown in FIGS. 2–4 the retaining clip 10 comprises a base 11 having an opening or aperture 12 shaped to receive the free end of an electrical connector. The base 11 is intended to contact at least a portion of the outer surface of the casing for an electronic device such as a computer which the base overlies, and to ground the clip with respect to the casing. Hence, where the panel of the casing is planar the base is similarly planar. Engagement means in the form of a pair of locking tabs 13, 14, that are preferably integral with the base 11, partially project across one end of the aperture 12. The locking tabs 13, 14 are shaped to engage detents provided on conventional electrical connectors. Engagement of the locking tabs 13, 14 with the detents on the electrical connector is by means of a sideways movement of the retaining clip 10 with respect to the electrical connector.

Extending upwardly from the base 11 are a plurality of resilient fingers 15 which form the walls of a cage shaped to receive the free end of a conventional electrical connector. Each finger 15, which is separated from its neighbor by a narrow slot 16, consists of first and second portions 17, 18. The first portion 17 extends substantially perpendicular to the base 11 whereas the second portion 18 describes an arc which, in a direction from the first portion 17 to its free end, firstly curves into the region above the aperture 12 and then away from that region. Thus, the curved surface of each arc portion 18 acts as a contacting surface to the free end of the electrical connector. The fingers 15 extend along both long sides of the clip and across each end of the clip. Inclusion of fingers at the short ends of the retaining clip is deemed optional.

Each of the fingers 15 is movable so as to allow passage of the electrical connector whilst also forming contact with the surface of the connector. Preferably the fingers are biased towards the volume immediately above the aperture 12 but are sufficiently resilient that on contacting the electrical connector, the individual fingers are capable of outward flexure to permit the passage of the connector. As a result of the arc portion 18 of each finger, though, the fingers retain contact with the electrical connector as it is inserted through the aperture 12 and are capable of maintaining contact even over the surface of an irregularly shaped connector once the connector is locked in position. The width of each finger 15 and its length are selected in dependent upon the contact force to be applied by the finger to the electrical connector. The fingers 15 of the retaining clip 10 act to ground the electrical connector across a wide area and, as the base 11 is on contact with the casing to the electronic device, the retaining clip acts to ground the electrical connector with respect to the casing. Thus, the fingers 15 function as em shielding to prevent the escape of electromagnetic radiation from the electronic device of which the electrical connector forms a part and to shield against external electromagnetic radiation.

The performance of two retaining clips 10 in providing em shielding has been tested using a standard emc chamber and the following are results that were obtained.

| | Margin with respect to Class A (dB) for selected frequencies (MHz) Peak measurements in bold, quasi-peak measurements in brackets | | | | | | | | | |
|---|---|---|---|---|---|---|---|---|---|---|
| **Retaining clip** | **656** | **700** | **756** | **984** | **1310** | **1970** | **2620** | **3280** | **3610** | **4590** |
| Testcase 1 | 17 | 20 | 17 | 14(11) | 23 | 9 | 13 | 12 | 12 | 13 |
| Testcase 2 | 17 | 13(10) | 10(6) | 14(10) | 15 | 7 | 10 | 9.5 | 9.5 | 9.5 |

Figure 5:
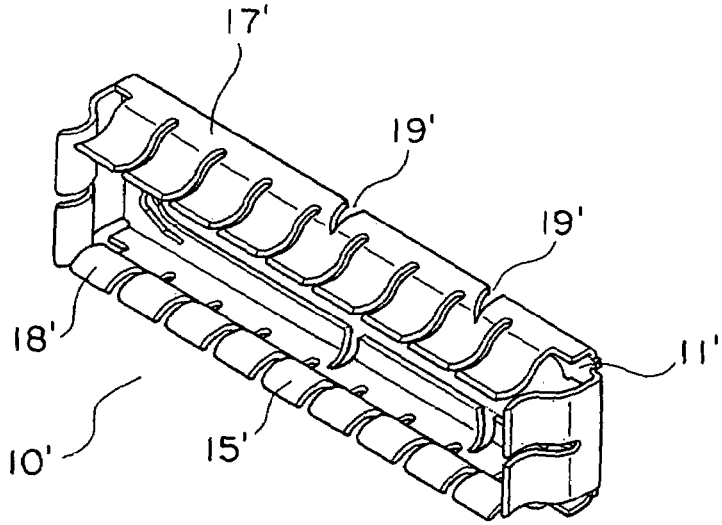
FIG. 5 is a perspective view from the front of an alternative retaining clip in accordance with the present invention.
Figure 6:
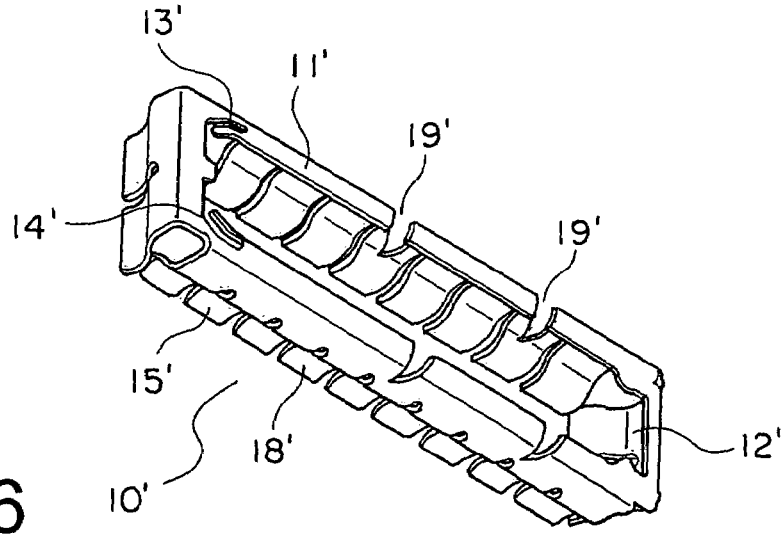
FIG. 6 is a perspective from the rear of the retaining clip of FIG. 5.
Figure 7:
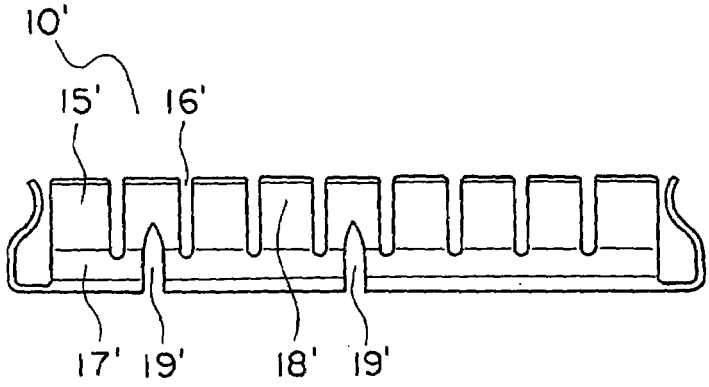
FIG. 7 is a plan view from one side of the retaining clip of FIGS. 5 and 6.

In FIGS. 5–7 an alternative version of the retaining clip is illustrated. This alternative version of the retaining clip is very similar to the retaining clip of FIGS. 2–4 and like reference numerals have been primed to indicate like features. The main difference between the two versions of the retaining clip is the inclusion of a plurality of slots 19' cut into the base 11' each of which extends into the first portion 17' of a respective one of the resilient fingers 15'. These slots interrupt what is a continuous base in the first version of the retaining clip 10. Thus, in this alternative version, the base 11' comprises a plurality of separate segments surrounding the aperture 12' with the fingers 15' acting as bridging elements to hold the separate segments of the base 11' together.

For both versions of the retaining clip described above, the clip 10 is preferably fabricated from a single metallic sheet that is cut by punching using a press and folded into the desired shape. This simplicity of construction greatly contributes to minimising the costs of fabrication.

Figure 8:
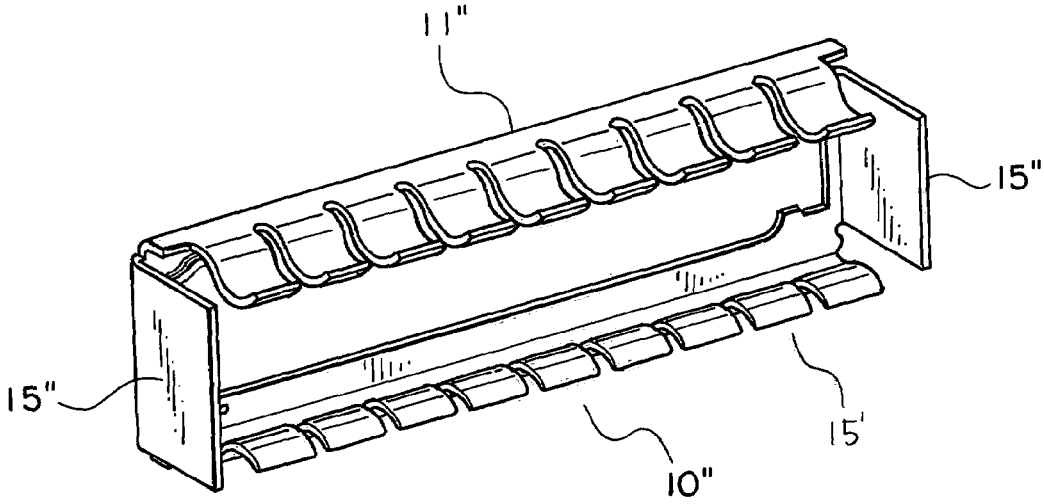
FIG. 8 is a perspective view from the front of a further alternative retaining clip in accordance with the present invention.
Figure 9:
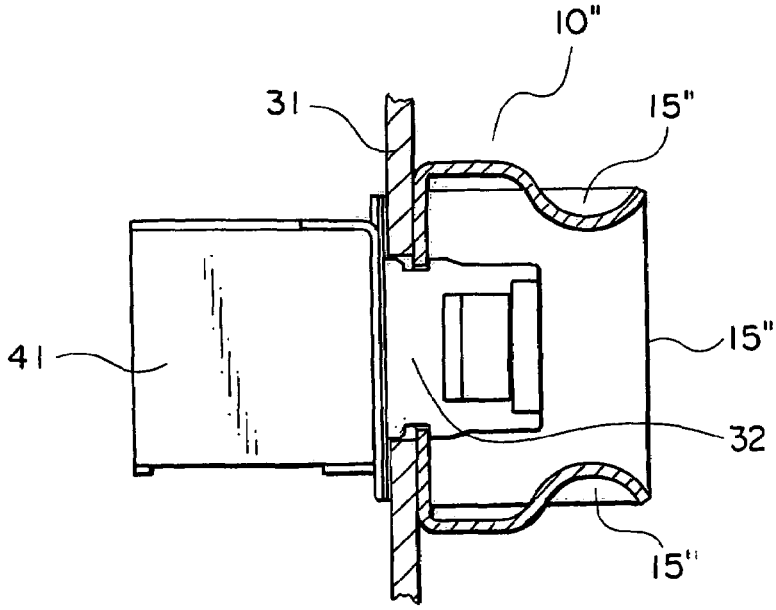
FIG. 9 is a sectional view of the state where the retaining clip of FIG. 8 and a receptacle connector are attached to a panel.
Figure 10:
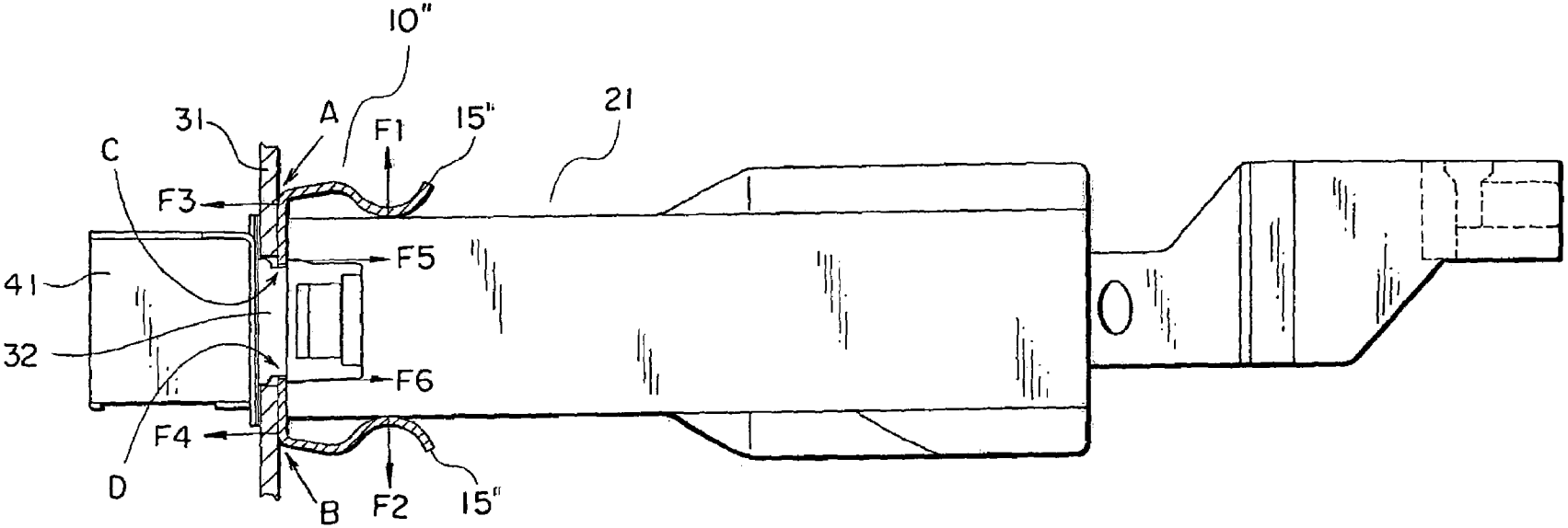
FIG. 10 is a sectional view of the state where a plug connector is inserted into the retaining clip of FIG. 9.

Referring to FIGS. 8 to 10, a further alternative version of the retaining clip will be described. The further alternative version of the retaining clip is similar to the retaining clip of FIGS. 2–4 and like reference numerals have been primed to indicate like features. The difference between the two versions will be described hereinafter.

In the first embodiment, each finger 15 is separated from its neighbor by a narrow slot 16. On the other hand, each of resiliently deformable flat plates 15" extending from opposite short sides of a base 11" in this version has no slot, as shown in FIG. 8. Therefore, each flat plate 15" is less resilient than each finger 15 in the first embodiment and is not easily deformable as compared with each finger 15 in the first embodiment.

Mechanical relationship among a retaining clip 10", a plug connector 21, and a panel 31 in this version will be described with reference to FIGS. 9 and 10.

The retaining clip 10" is fitted into an aperture 32 of the panel 31 as shown in FIG. 9. In FIG. 9, the plug connector 21 is not yet inserted into the retaining clip 10".

In FIG. 10, the plug connector 21 is inserted into the retaining clip 10".

In this state, the plug connector 21 applies forces F1, F2 to each flat plate 15" in the direction of arrows, respectively. Then, forces F3, F4, F5, F6 are produced at four points A, B, C, D of the retaining clip 10" in the direction of arrows, respectively. F3, F4 are forces exerted by the retaining clip 10" to push the panel 31. F5, F6 are forces exerted by the retaining clip 10" to push the plug connector 21. Under the forces F1, F2, F3, F4, F5, and F6, the plug connector 21, the retaining clip 10", the panel 31, and a receptacle connector 41 are electrically connected and grounded.

Figure 11:
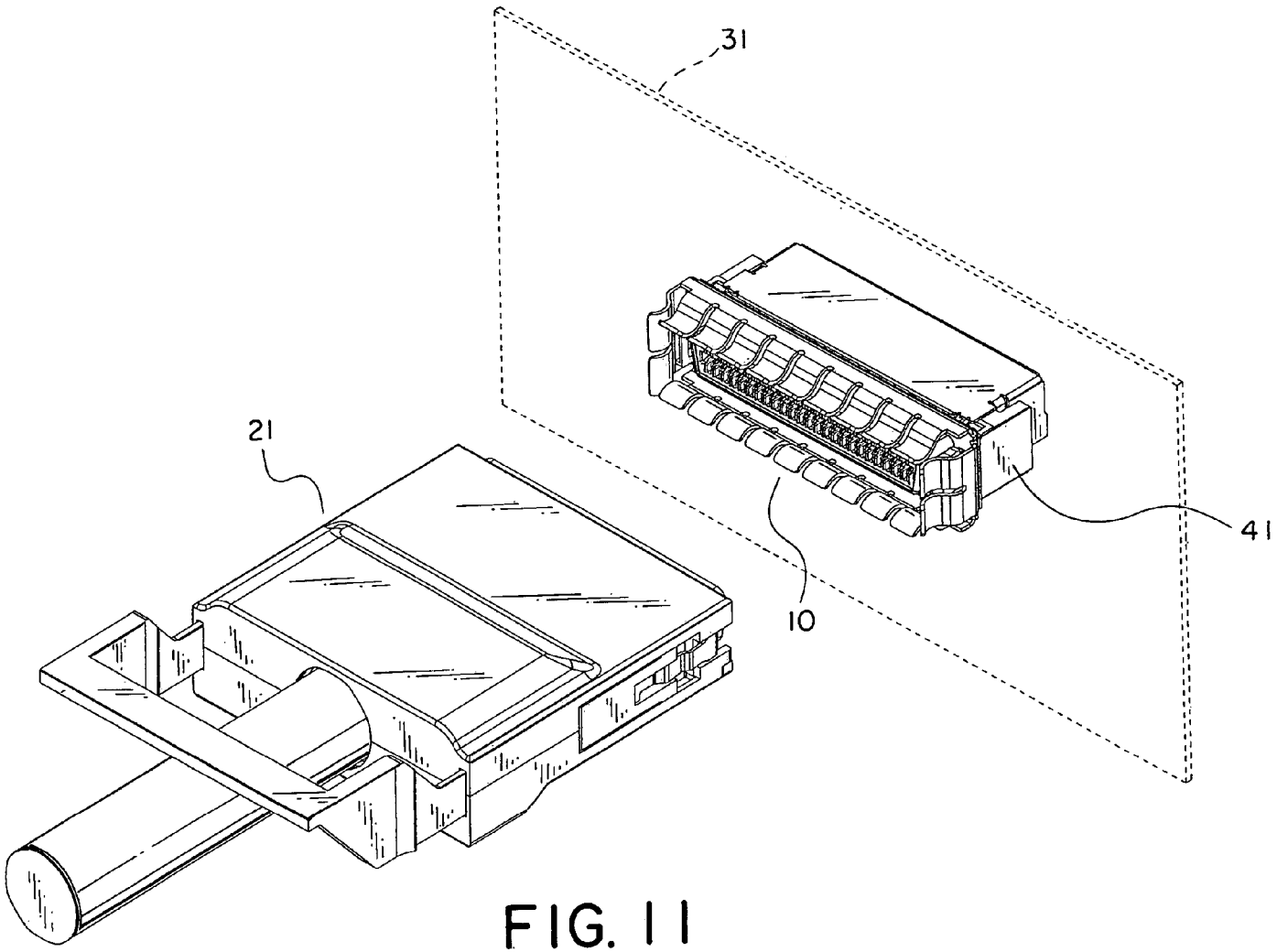
FIG. 11 is a perspective view of the state after the retaining clip of FIG. 2 and the receptacle connector are attached to the panel and before the plug connector is inserted into the retaining clip.
Figure 12:
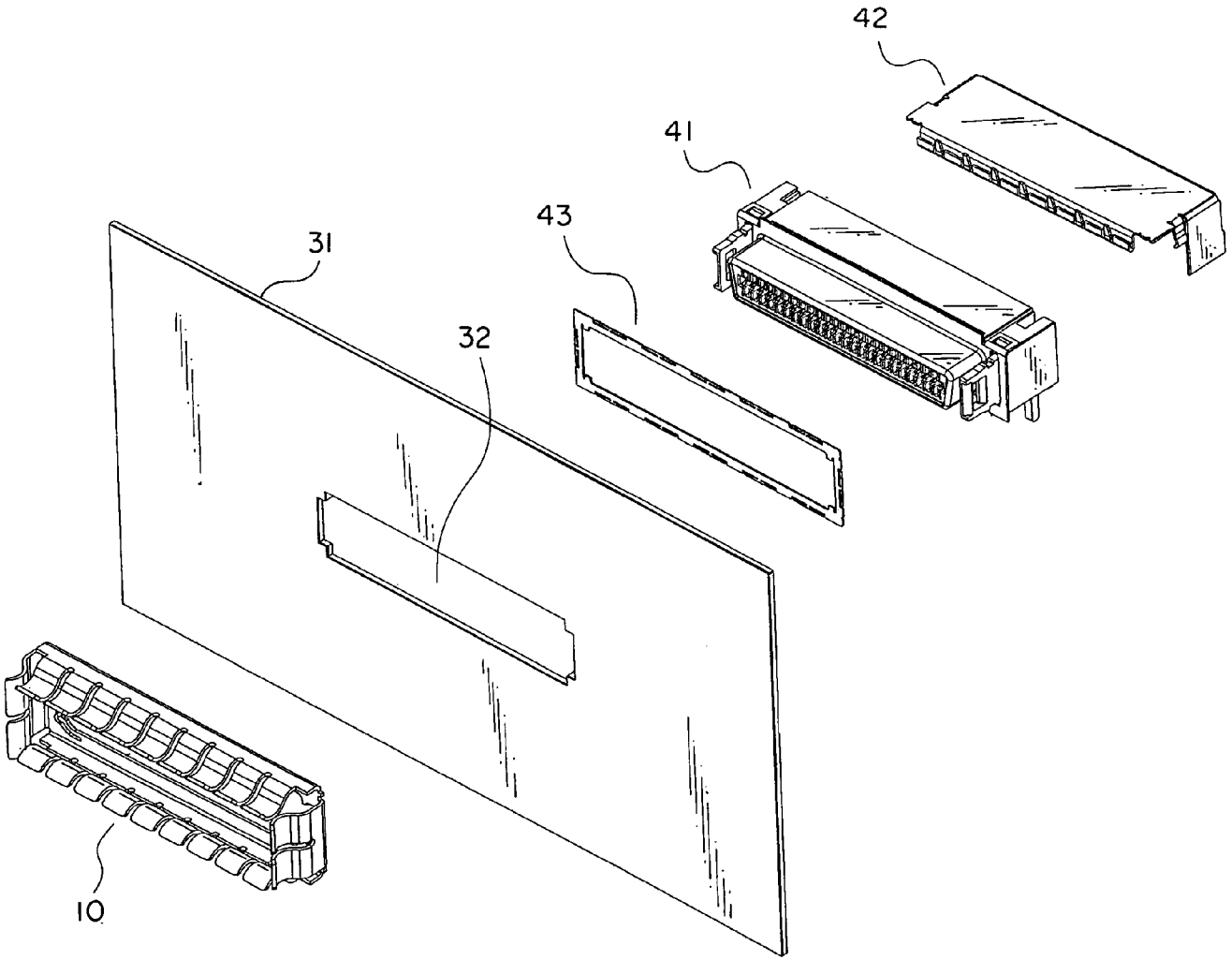
FIG. 12 is an exploded perspective view of the retaining clip of FIG. 2, the receptacle connector, a shield cover, a gasket, and the panel.

Referring to FIGS. 11 and 12, the structure of fitting the retaining clip 10 will be described in detail.

In FIG. 12, a shield cover 42 is attached to the receptacle connector 41 from the upper surface of the receptacle connector 41. A gasket 43 is fitted to the receptacle connector 41 from the front surface of the receptacle connector 41. Thereafter, the receptacle connector 41 is inserted into the aperture 32 of the panel 31 from the rear surface of the panel 31 and the retaining clip 10 is inserted into the aperture 32 from the front surface of the panel 31. In the state shown in FIG. 11, the plug connector 21 is inserted into the retaining clip 10.

The retaining clips in accordance with the invention thus provide both a locking mechanism for holding an electrical connector in place when inserted through an aperture in the casing of an electronic device such as a computer and also provides em shielding by grounding a wide surface area of the electrical connector to the outer surface of the casing.

Changes to the retaining clips described above are envisaged without departing from the present invention which is limited in scope by the accompanying claims only.

What is claimed is:

1. A retaining clip for securing an electrical connector to be inserted through an opening formed in a panel, the retaining clip comprising:

a base which includes: a surface which contacts at least a portion of a surface of the panel over which the base is positioned, an aperture extending through the base to receive a free end of the electrical connector, and at least one locking tab which projects into the aperture and which is engageable with detents on the electrical connector by means of sideways movement of the retaining clip with respect to the electrical connector while the free end of the electrical connector is inserted in the aperture, so as to hold the electrical connector; and a plurality of fingers which extend away from the base and which are displaceable to allow insertion of a mating connector and to contact a surface of the mating connector, whereby the retaining clip shields the surface of the mating connector with respect to the panel;

wherein each of the fingers comprises a first portion which extends substantially perpendicularly with respect to the base.

2. A retaining clip as claimed in 1, wherein the base is substantially planar.

3. A retaining clip as claimed in claim 1, wherein the base comprises a plurality of segments that are held in position around the aperture by respective bridging elements.

4. A retaining clip as claimed in 3, wherein each of the bridging elements comprises at least one of the fingers.

5. A retaining clip as claimed in claim 1, wherein the plurality of fingers are biased towards a volume at a side of the aperture of the clip.

6. A retaining clip as claimed in claim 1, wherein the base has a rectangular shape, and the retaining clip further comprises a single flat plate extending away from each of opposing short sides of the rectangular shape.

7. A retaining claim as claimed in claim 1, wherein each of the fingers further comprises a second portion which is arc-shaped and curves into a volume at a side of the aperture, and wherein the first portion of each of the fingers is attached to the base and the second portion is attached to the first portion.

* * * * *